US007844461B2

(12) United States Patent
Yamada

(10) Patent No.: US 7,844,461 B2
(45) Date of Patent: Nov. 30, 2010

(54) INFORMATION PROCESSING APPARATUS AND METHOD

(75) Inventor: Masayuki Yamada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1468 days.

(21) Appl. No.: 10/449,071

(22) Filed: Jun. 2, 2003

(65) Prior Publication Data

US 2004/0019490 A1 Jan. 29, 2004

(30) Foreign Application Priority Data

Jun. 5, 2002 (JP) ..... 2002-164621

(51) Int. Cl.
*G10L 13/00* (2006.01)

(52) U.S. Cl. ..... 704/260; 704/220; 704/246; 704/258; 704/271

(58) Field of Classification Search ..... 704/246, 704/220, 268, 258, 260, 271
See application file for complete search history.

(56) References Cited

U.S. PATENT DOCUMENTS 5,797,116 A 8/1998 Yamada et al. ..... 704/10
6,108,628 A 8/2000 Komori et al. ..... 704/256
6,161,091 A * 12/2000 Akamine et al. ..... 704/258
6,205,421 B1 * 3/2001 Morii ..... 704/226
7,010,481 B2 * 3/2006 Takizawa ..... 704/220
7,149,682 B2 * 12/2006 Yoshioka et al. ..... 704/205
2001/0056346 A1 12/2001 Ueyama et al. ..... 704/246
2002/0184027 A1 * 12/2002 Brittan et al. ..... 704/258

* cited by examiner

*Primary Examiner*—Richemond Dorvil
*Assistant Examiner*—Leonard Saint Cyr
(74) *Attorney, Agent, or Firm*—Fitzpatrick, Cella, Harper & Scinto

(57) ABSTRACT

Provided are an information processing apparatus and method so adapted that if a plurality of speech output units having a speech synthesizing function are present, a conversion is made to speech having mutually different feature quantitys so that a user can readily be informed of which unit is providing the user with information such as an alert information. Speech data that is output from another speech output unit is input from a communication unit (8) and stored in a RAM (7). A central processing unit (1) extracts a feature quantity relating to the input speech data. Further, the central processing unit (1) utilizes a speech synthesis dictionary (51) that has been stored in a storage device (5) and generates speech data having a feature quantity different from that of the extracted feature quantity. The generated speech data is output from a speech output unit (4).

3 Claims, 13 Drawing Sheets

Fig. 3

A quick brown fox jumps over the lazy dog.

Fig. 4

ʌ kwik braun fɔks dʒʌmps ouvər ðə leizi dɔ:g

INFORMATION PROCESSING APPARATUS AND METHOD

FIELD OF THE INVENTION

This invention relates to an information processing apparatus and method for processing voice data.

BACKGROUND OF THE INVENTION

Recent advances in speech synthesizing techniques and an increase in the storage capacity of storage devices provided in speech output equipment have made it possible to synthesize speech of a variety of qualities. Speech synthesis has been used heretofore for the purpose of providing a user with information or warnings by equipping a speech output unit with an information processor or the like for synthesizing speech.

With the conventional method set forth above, however, a problem is encountered. Specifically, when a plurality of devices (speech output units) each having a speech synthesizing function are present in a certain space and the user is presented with information such as an alert using synthesized speech that is output from each of these speech output units, it is difficult for the user to determine which device has synthesized and output the speech.

SUMMARY OF THE INVENTION

The present invention has been proposed to solve the problem of the prior art and its object is to provide an information processing apparatus and method so adapted that if a plurality of speech output units having a speech synthesizing function are present, a conversion is made to speech having mutually different features so that a user can readily be informed of which unit is providing the user with information such as an alert information.

According to the present invention, the foregoing object is attained by providing an information processing apparatus for controlling a speech output unit, comprising: input means for inputting speech data; extraction means for extracting a feature quantity relating to the input speech data; and generating means for generating speech data having a feature quantity different from the extracted feature quantity.

Further, according to the present invention, the foregoing object is attained by providing an information processing apparatus for controlling a speech output unit, comprising: input means for inputting speech data that is output from another speech output unit; storage means for storing a plurality of dictionaries for generating speech; first extraction means for extracting a feature quantity relating to the input speech data; second extraction means for extracting a feature quantity relating to the generated speech data; calculation means for calculating a differential feature quantity between the feature quantity relating to the input speech data and the feature quantity relating to the generated speech data; and selection means for selecting speech data that prevails when a predetermined differential feature quantity has been calculated.

Further, according to the present invention, the foregoing object is attained by providing an information processing apparatus for controlling a speech output unit, comprising: input means for inputting speech data that is output from another speech output unit; storage means for storing a plurality of dictionaries for generating speech; extraction means for extracting a feature quantity relating to the input speech data; calculation means for calculating, from the feature quantity, a maximum speaker-to-speaker distance feature quantity for which an average speaker-to-speaker distance is maximum; parameter generating means for generating a sound-quality conversion parameter based upon a feature quantity relating to speech data, which has been generated using the dictionaries, and the maximum speaker-to-speaker distance feature quantity; and generating means for generating speech data using the sound-quality conversion parameter.

Further, according to the present invention, the foregoing object is attained by providing an information processing apparatus for controlling a speech output unit, comprising: feature quantity input means for inputting a feature quantity of speech data that is output from another speech output unit; and generating means for generating speech data having a feature quantity different from that of the input feature quantity.

Further, according to the present invention, the foregoing object is attained by providing an information processing apparatus for controlling a speech output unit, comprising: feature quantity input means for inputting a feature quantity of speech data that is output from another speech output unit; storage means for storing a plurality of dictionaries for generating speech; generating means for generating speech data using the dictionaries; extraction means for extracting a feature quantity relating to the generated speech data; calculation means for calculating an average feature quantity distance between the feature quantity of the input speech data and a feature quantity relating to the generated speech data; and selection means for selecting speech data that prevails when a maximum average feature quantity-to-feature quantity distance has been calculated.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 3 is a diagram illustrating an example of text for which speech is to be synthesized in a first embodiment of the invention;

FIG. 4 is a diagram illustrating an example of text for which speech is to be synthesized expressed by phonetic text in the first embodiment;

DETAILED DESCRIPTION OF THE PREFERRED EMBODIMENTS

A speech output unit and an information processing apparatus for controlling the speech output unit in preferred embodiments of the present invention will now be described with reference to the drawings.

First Embodiment

Figure 1:
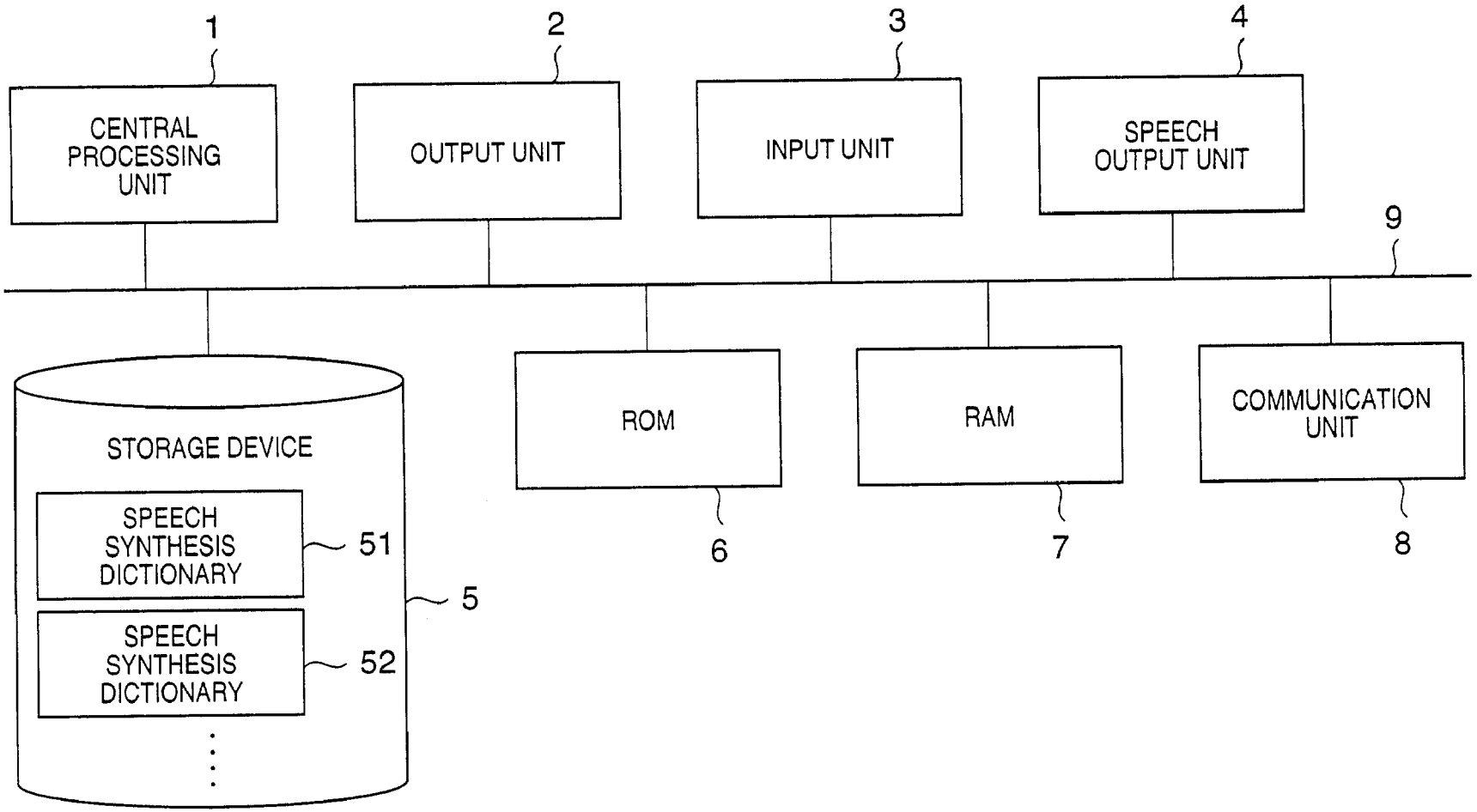
FIG. 1 is a block diagram illustrating a hardware implementation of an information processing apparatus for controlling a speech output unit according to the present invention.

FIG. 1 is a block diagram illustrating a hardware implementation of an information processing apparatus for controlling a speech output unit according to the present invention. The apparatus includes a central processing unit 1 for executing processing such as calculation of various numerical values and control. The central processing unit 1 performs operations relating to various processing associated with the information processing apparatus of the present invention. An output unit 2 is for presenting information to a user of a monitor or speaker, etc.

An input unit 3 is a device such as a touch-sensitive panel or keyboard by which a user applies operating command information or inputs character information. Furthermore, a speech output unit 4 is for outputting speech data obtained by speech synthesis.

A storage device 5 is a disk device or non-volatile memory, etc., and holds dictionaries for speech synthesis, etc. Numerals 51 and 52 denote examples of speech synthesis dictionaries (dictionaries for generating speech) that have been stored in the storage device 5. It should be noted that the storage device 5 may be a removable external storage device.

A ROM 6 is a storage device for reading only and stores programs and various fixed data relating to the information processing method according to the present invention. Further, a RAM 7 is a storage device for holding information temporarily. The RAM 7 holds generated data and various flags, etc., temporarily.

Furthermore, a data communication unit 8 is implemented by various communication cards inclusive of a LAN card and is used for communicating with other devices. The central processing unit 1, variable-length code generator 2, input unit 3, speech output unit 4, storage device 5, ROM 6, RAM 7 and communication unit 8 are interconnected by a bus 9.

According to this embodiment, the input unit 3 functions as text input means for inputting prescribed text data. The communication unit 8 functions as transmitting means for transmitted entered text data and also as input means for inputting speech data that is output from another speech output unit.

The central processing unit 1 further functions as first extraction means for extracting a feature quantity relating to the input speech data; generating means for generating speech data having a feature quantity different from that of the extracted feature quantity; second extraction means for extracting a feature quantity relating to the generated speech data; calculation means for calculating a differential feature quantity between the feature quantity relating to the input speech data and the feature quantity relating to the generated speech data; and selection means for selecting speech data that prevails when a predetermined differential feature quantity has been calculated.

Figure 2:
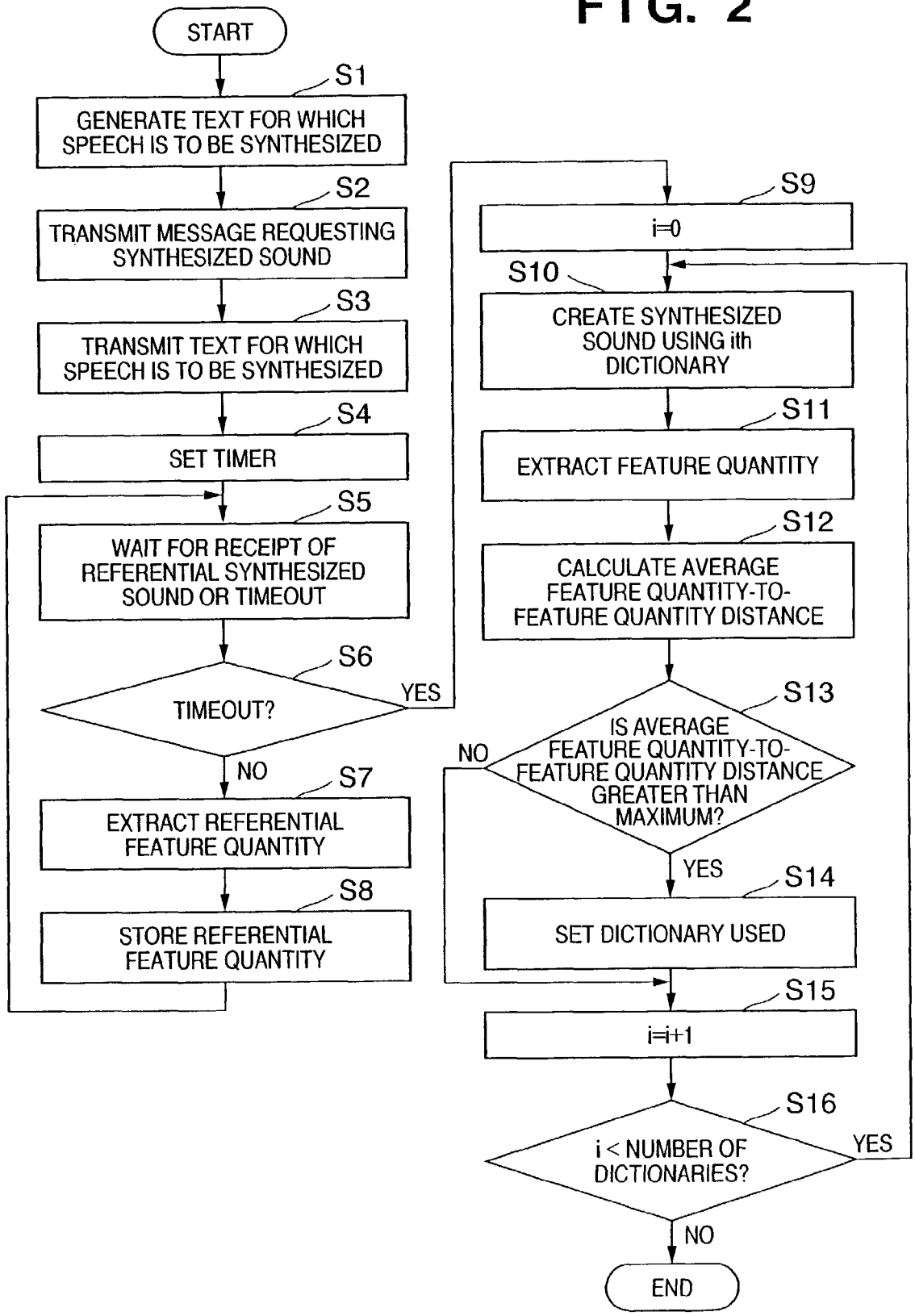
FIG. 2 is a flowchart useful in describing an information processing procedure for controlling a speech output unit according to the present invention.

FIG. 2 is a flowchart useful in describing an information processing procedure for controlling a speech output unit according of the present invention. This embodiment will be described in accordance with the flowchart of FIG. 2. In this embodiment, a plurality of dictionaries for speech synthesis having different properties are prepared and stored in the storage device 5 beforehand and the most suitable dictionary is selected from among these dictionaries.

First, text for which speech is to be synthesized is generated (step S1). An expression method in which natural language or pronunciation such as phonetic text is written directly is available as a method of expressing the text for which speech is to be synthesized. In this embodiment, either method may be used or both may be used conjointly.

FIG. 3 is a diagram illustrating an example of text for which speech is to be synthesized in this embodiment. Furthermore, FIG. 4 is a diagram illustrating an example of text for which speech is to be synthesized expressed by phonetic text in this embodiment. The text for which speech is to be synthesized may be generated dynamically or may be obtained by reading in predetermined content from the ROM 6, etc.

Next, a message requesting a synthesized sound for the text generated at step S1 is transmitted (step S2). Since the destination of this transmission is all devices (speech output units) connected on a network, a broadcast transmission is employed. The text for which speech is to be synthesized generated at step S1 is transmitted to another speech output unit (step S3).

Next, a timer is set so as to time-out upon elapse of a predetermined period of time (step S4). The apparatus then waits for receipt of a referential synthesized sound (speech data) from another device or for the set timeout (step S5).

Next, it is determined whether the result obtained at step S5 is timeout (step S6). If timeout is determined ("YES" at step S6), then processing proceeds to step S9, which is for setting an initial value in a loop counter. If timeout is not determined ("NO" at step S6), on the other hand, then processing proceeds to step S7, which is for extracting a referential feature quantity.

At step S7, a feature quantity of the speech data from the other speech output unit is extracted from the referential synthesized sound received at step S5. A cepstrum or fundamental frequency can be used as an example of a feature quantity. The feature quantity extracted at step S7 is stored in the ROM 7 or the like (step S8) and processing returns to step S5, where the apparatus again waits for receipt of the reference synthesized sound or for timeout.

A loop counter i is set to an initial value 0 at step S9, then a synthesized sound for the text for which speech is to be synthesized generated at step S1 is generated using an ith dictionary for speech synthesis (step S10). A feature quantity of the synthesized sound created at step S10 is extracted (step S11).

Next, the average feature quantity-to-feature quantity distance between the referential feature quantity stored at step S8 and the feature quantity extracted at step S11 is calculated (step S12). A Mahalanobis distance or the like can be used as the measure of the distance between feature quantities.

Figure 14:
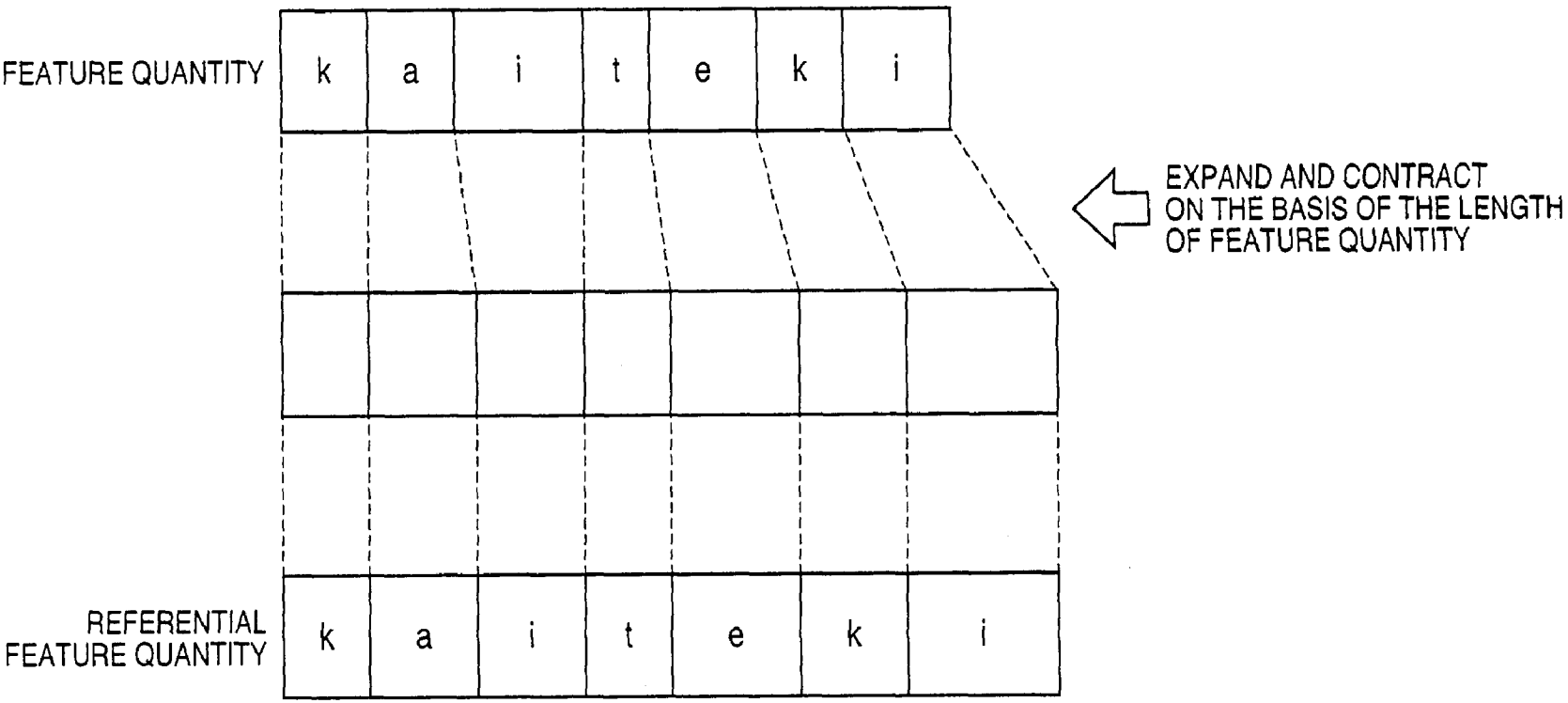
FIG. 14 is a diagram illustrating a relation between a feature quantity and a referential feature quantity.

Note, it is possible to raise the reliability of the feature quantity-to-feature quantity distance by expanding and contracting one or both of the feature quantity and the referential feature quantity obtained in step S11 before obtaining the average feature quantity-to-feature quantity distance in step S12 as shown in FIG. 14 when the feature quantity is time series data. FIG. 14 is a diagram illustrating a relation between a feature quantity and a referential feature quantity. For example, a DP matching method used by a speech recognition etc is used in order to expand and contract one or both of the feature quantity and the referential feature quantity.

Next, it is determined whether the average feature quantity-to-feature quantity distance calculated at step S12 is greater than the maximum average feature quantity-to-feature quantity distance in the speech synthesis dictionaries 0 to (i−1) (step S13). If the determination rendered is "YES", processing proceeds to step S14, which is for setting the dictionary to be used. If the determination rendered is "NO", on the other hand, then processing proceeds to step S15, which is for updating the loop counter.

More specifically, the dictionary used for synthesizing speech is set to an ith speech synthesis dictionary at step S14, then the loop counter is updated at step S15. It should be noted that if i is 0, a "YES" decision is rendered at step S13 and a $0^{th}$ speech synthesis dictionary is set at step S14.

The loop counter i is incremented (step S15). Next, it is determined whether the value in loop counter i is less than the number of all speech synthesis dictionaries that have been stored in the storage device 5 (step S16). If a "YES" decision is rendered, processing proceeds to step S10 for creating a dictionary. If a "NO" decision is rendered, on the other hand, then information processing is terminated.

Figure 5:
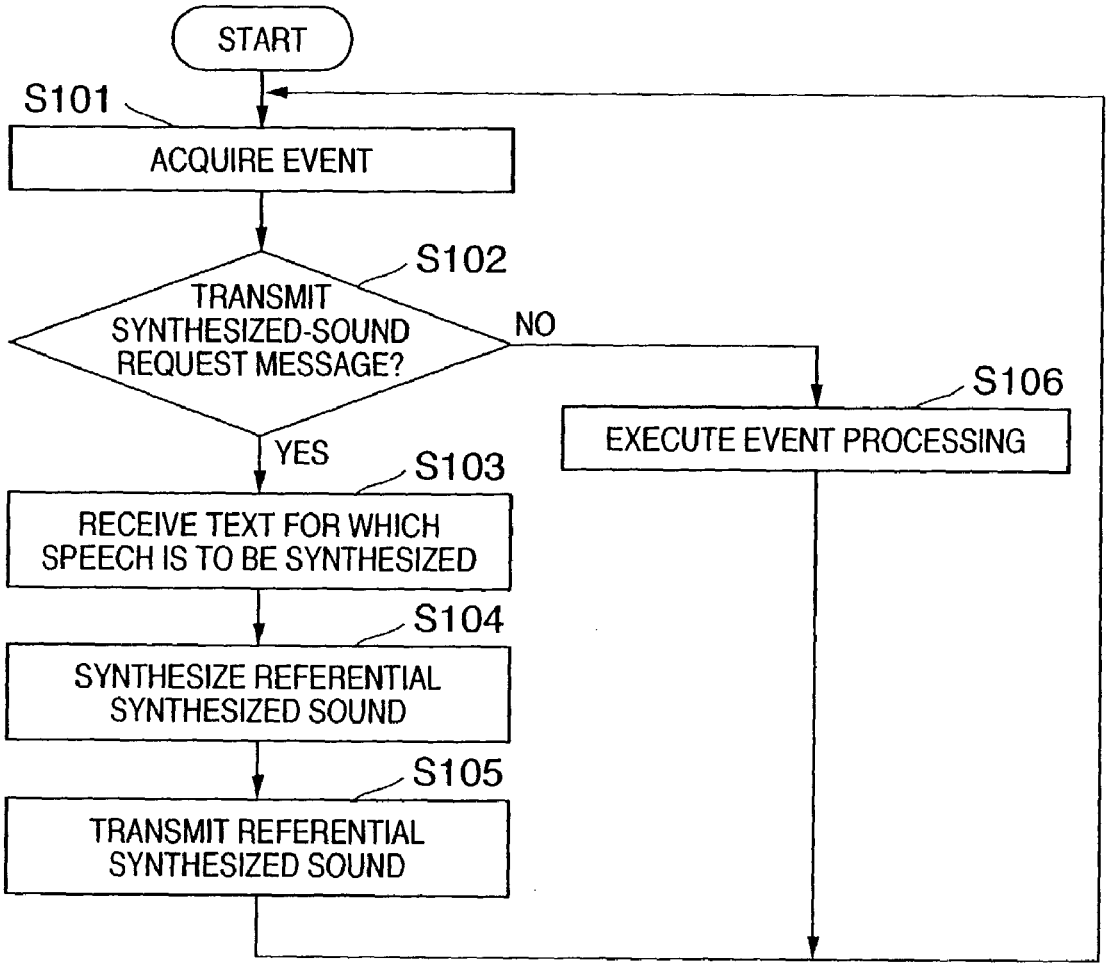
FIG. 5 is a flowchart useful in describing the flow of information processing on the side of a speech output unit.

Described next will be operation on the side of a speech output unit that receives the synthesized-sound request message transmitted at step S2. FIG. 5 is a flowchart useful in describing the flow of information processing on the side of the speech output unit.

First, the unit acquires an event such as operation of a device by the user, receipt of data from a network or a change in internal status (step S101). Next, it is determined whether the event acquired at step S101 is receipt of a message requesting synthesized sound (step S102). If it is determined that such a message has been received ("YES" at step S102), then processing proceeds to step S103, which is for receiving text for which speech is to be synthesized. Otherwise ("NO" at step S102), processing proceeds to step S106, where event processing is executed.

The text for which speech is to be synthesized is received at step S103. The text received at step S103 is subjected to speech synthesis to obtain a referential synthesized sound (step S104). The referential synthesized sound synthesized at step S104 is transmitted (step S105) and processing proceeds to the event acquisition step S101.

Among events acquired at step S101, events other than receipt of the synthesized-sound request message are processed at step S106, after which processing returns to step S101.

Second Embodiment

In the first embodiment described above, a plurality of dictionaries for speech synthesis having different properties are prepared and the most suitable dictionary is selected from among these dictionaries. Implementation using a technique for converting speech quality also is possible. In this embodiment, implementation based upon conversion of speech quality will be described.

Figure 6:
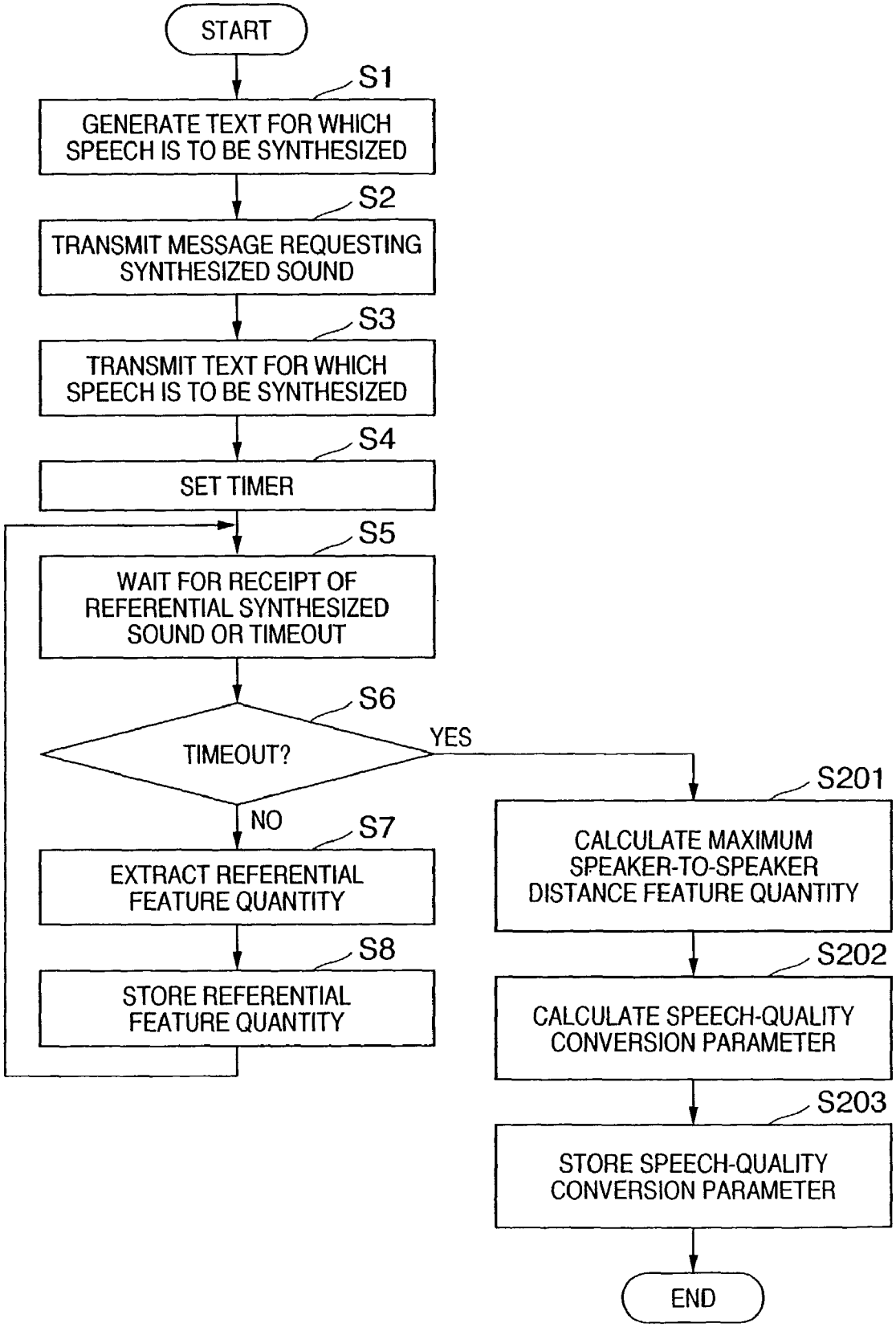
FIG. 6 is a flowchart useful in describing processing according to a second embodiment based upon conversion of speech quality.

FIG. 6 is a flowchart useful in describing processing according to an embodiment based upon conversion of speech quality. This embodiment will be described in accordance with the flowchart of FIG. 6.

In the flowchart of this embodiment, processing from step S1 for generating text for which speech is to be synthesized to step S8 for storing a referential feature quantity is the same as processing of steps S1 to S8 in the first embodiment described above.

At step S201 in FIG. 6, a feature quantity for which the average distance between speaking individuals (speakers) is greatest calculated from the referential feature quantity stored at step S8. This calculation is the same as solving a linear or non-linear programming problem because a feature quantity has an allowable range. For example, in a case where a Euclidean distance or Mahalanobis distance is used as the distance and the allowable range of a feature quantity is expressed by a linear equation, the feature quantity for which the average distance between speaking individuals is greatest can be found by quadratic programming.

Next, a parameter for speech quality conversion is calculated (step S202). The speech-quality conversion parameter is calculated using the feature quantity, obtained at step S201, for which the distance between speaking individuals is greatest and the feature quantity possessed by the speech synthesis dictionary. The speech-quality conversion parameter calculated at step S202 is stored at step S203 and processing is then terminated.

Figure 7:
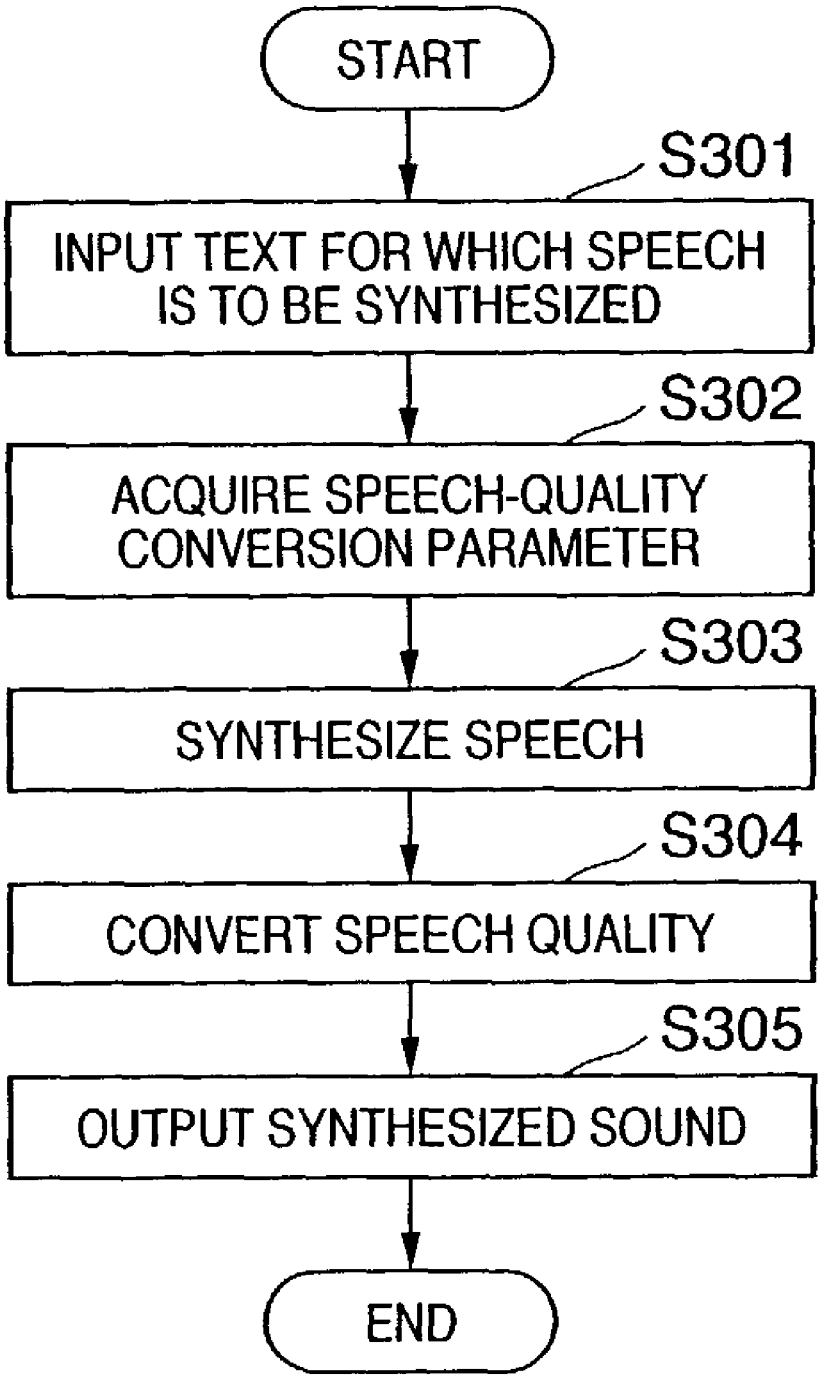
FIG. 7 is a flowchart useful in describing processing on the side of a speech output unit when speech is synthesized in the second embodiment.

FIG. 7 is a flowchart useful in describing processing on the side of a speech output unit when speech is synthesized in this second embodiment. First, text for which speech is to be synthesized is input (step S301). Next, the speech-quality conversion parameter stored at step S203 is acquired (step S302).

Speech corresponding to the text for which speech is to be synthesized entered at step S301 is synthesized (step S303). Next, the speech synthesized at step S303 is subjected to conversion of speech quality (step S304) using the parameter acquired at step S302. The synthesized sound resulting from the conversion performed at step S304 is output (step S305).

In the above embodiment, speech quality is converted when speech is synthesized. However, the conversion of speech quality may be performed with regard to the speech synthesis dictionaries.

Figure 8:
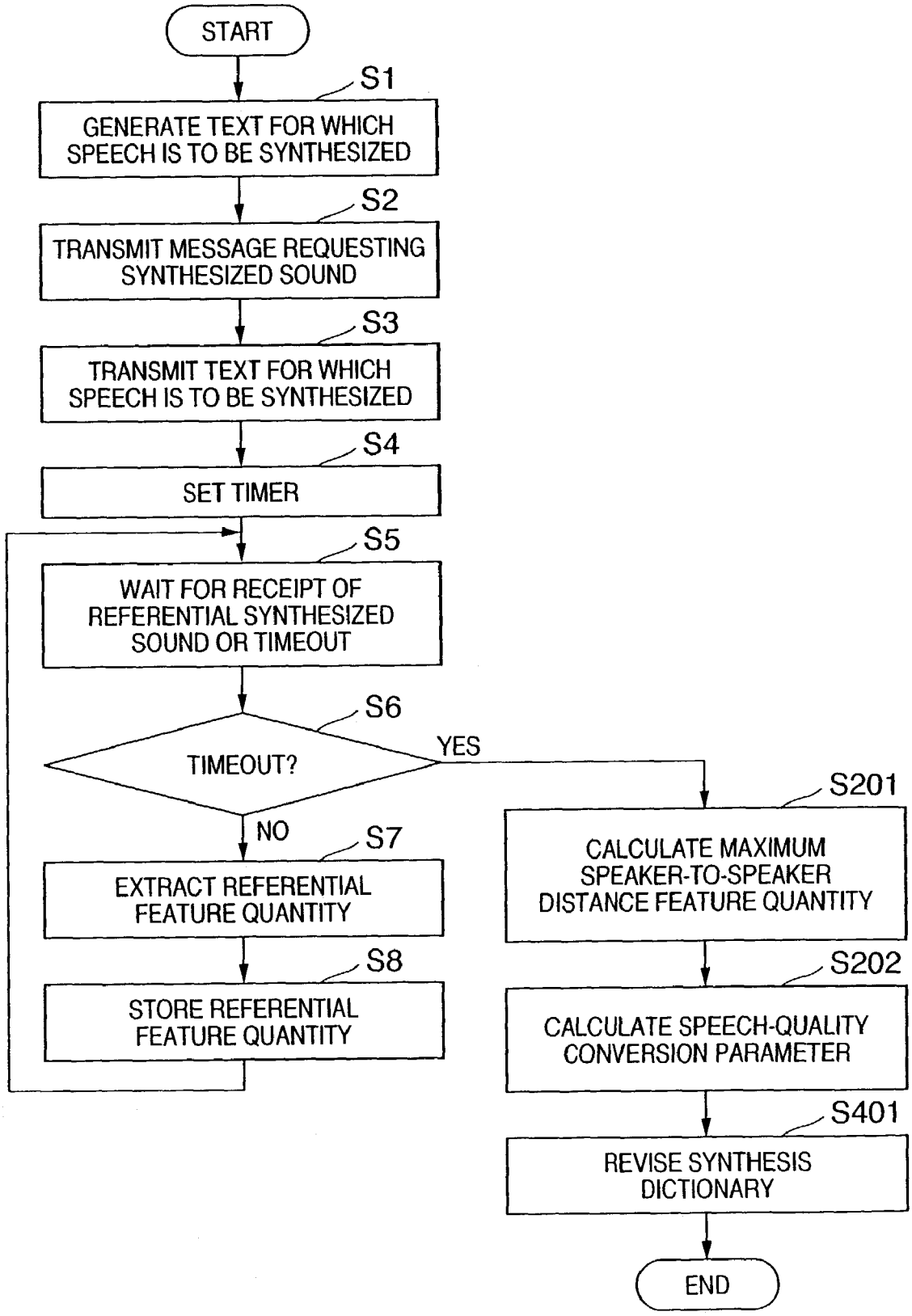
FIG. 8 is a flowchart useful in describing processing for applying a speech-quality conversion to a speech synthesis dictionary in the second embodiment.

FIG. 8 is a flowchart useful in describing processing for applying a speech-quality conversion to a speech synthesis dictionary in the second embodiment. In this case, the conversion is implemented by providing a step 401, which is for revising a speech synthesis dictionary, instead of step S203 at which the speech-quality conversion parameter is stored.

Third Embodiment

The first and second embodiments send and receive synthesized speech. This embodiment, however, relates to a case where a feature quantity is sent and received instead of synthesized voice.

Figure 9:
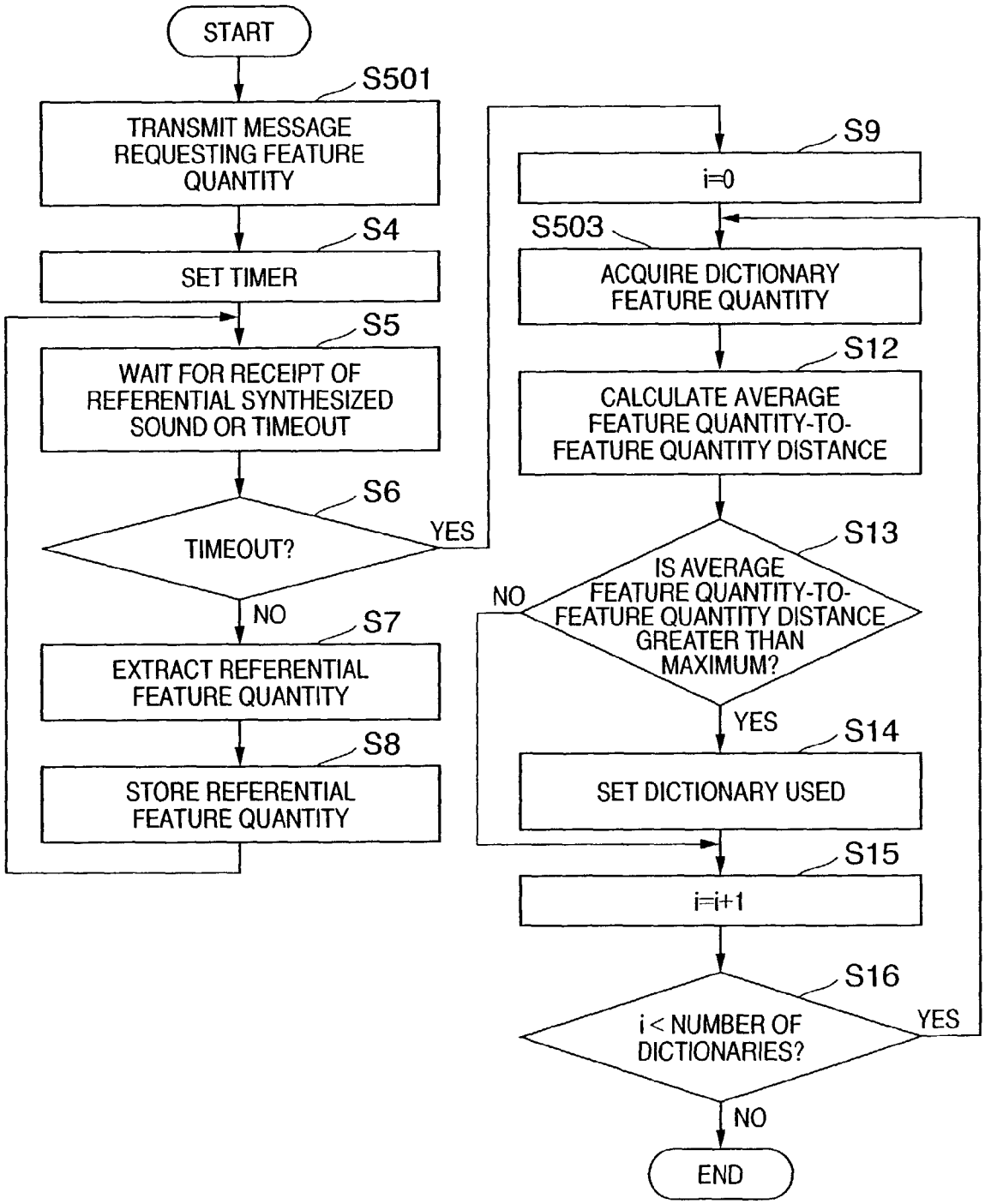
FIG. 9 is a flowchart useful in describing processing of a third embodiment for sending and receiving a feature quantity instead of synthesized speech.

FIG. 9 is a flowchart useful in describing processing of a third embodiment for sending and receiving a feature quantity instead of synthesized speech. First, a message requesting a feature quantity is transmitted to another speech output unit (step S501). Since the destination of this transmission is all devices connected on a network, a broadcast transmission is employed.

Next, a timer is set so as to time-out upon elapse of a predetermined period of time (step S4). The apparatus then waits for receipt of a feature quantity from another device or for the set timeout (step S5).

Next, it is determined whether the result obtained at step S5 is timeout (step S6). If timeout is determined ("YES" at step S6), then processing proceeds to step S9, which is for setting an initial value in a loop counter. If timeout is not determined ("NO" at step S6), on the other hand, then processing proceeds to step S7. At step S7, a referential feature quantity is extracted. At step S8, the referential feature quantity that has been extracted at step S7 is stored, after which control proceeds to step S5.

A loop counter i is set to an initial value 0 at step S9, then a feature quantity possessed by the ith speech synthesis dictionary is acquired (step S503). This is followed by processing from step S12, which is for calculating the average feature quantity-to-feature quantity distance, to step S16, at which it is determined whether the loop has ended. This processing is similar to that of step S12 to S16 in the first embodiment described above.

A cepstrum or fundamental frequency can be used as a feature quantity in this embodiment. In particular, it is possible to use effectively not only the average value of a cepstrum or fundamental frequency but also a codebook obtained by clustering these. The codebook of a feature quantity generally is used as a technique that is effective in recognizing a speaking individual.

The method of sending and receiving synthesized speech as in the manner of the first and second embodiments described above is advantageous in that the dependence of each device upon the speech synthesizing method is low and in that there are only a few agreements (protocols) between devices relating to the nature of communication. However, it is difficult to include all phonemes of a speech synthesis dictionary in text for which speech is to be synthesized. By contrast, since feature quantities are sent and received in this embodiment, the embodiment is advantageous in that the inclusion of feature quantities possessed by a speech synthesis dictionary can be performed comparatively easily.

Further, this embodiment has been described based upon the first embodiment, in which an appropriate dictionary is selected from a plurality of speech synthesis dictionaries. However, the embodiment can be implemented based upon adaptation to a speaking individual.

Fourth Embodiment

Figure 10:
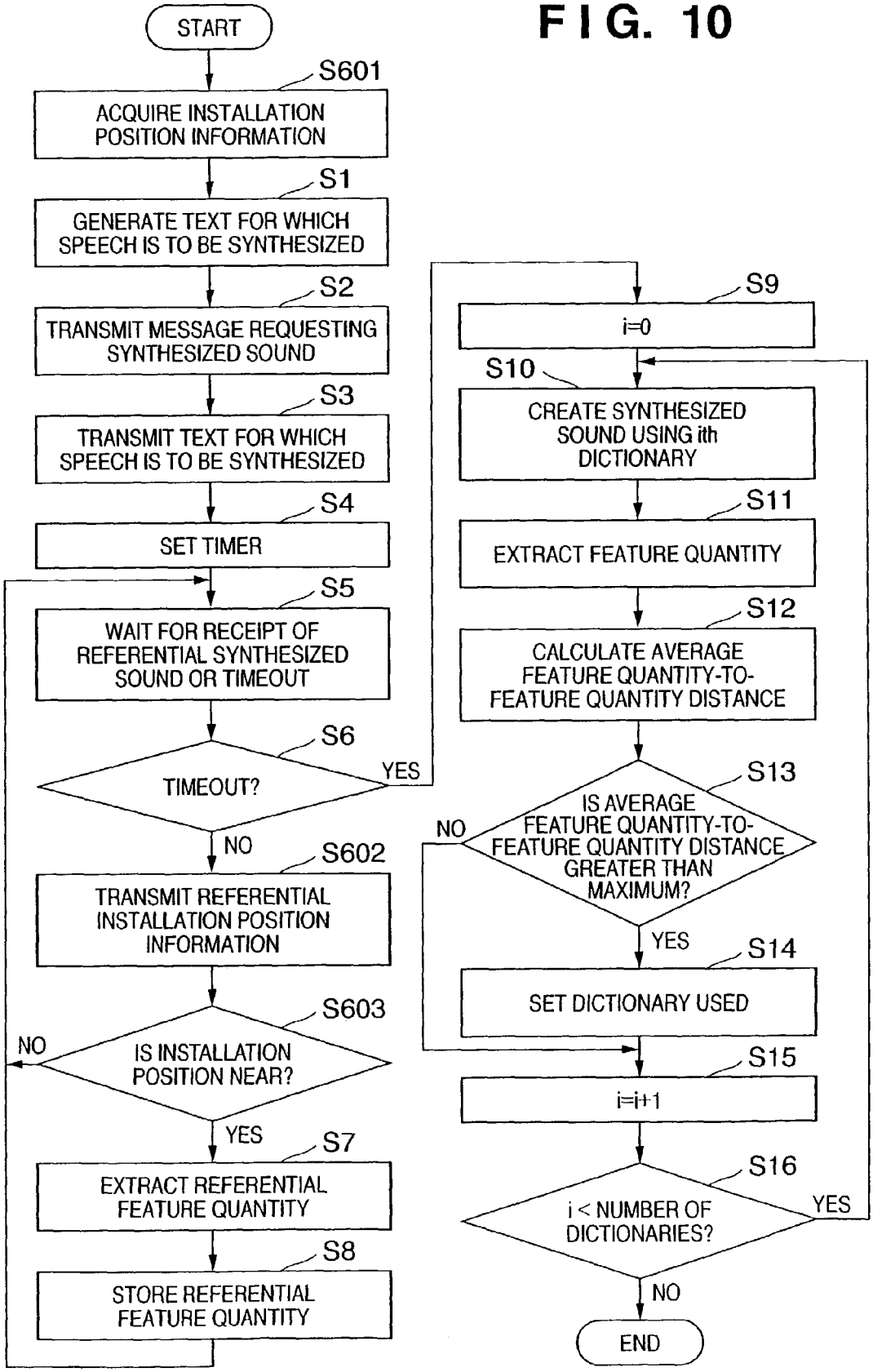
FIG. 10 is a flowchart useful in describing processing of an embodiment in a case where the position of a speech output unit is taken into consideration in the processing according to the first embodiment.

In the third embodiment, it is possible to take the position at which a device (speech output unit) is installed into consideration and adopt it as the object of a feature quantity-to-feature quantity distance evaluation only in a case where the position of installation is nearby. FIG. 10 is a flowchart useful in describing processing of an embodiment in a case where the position of a speech output unit is taken into consideration in the processing according to the first embodiment.

First, the position at which the device has been installed is acquired (step S601). The installation position of the device may be specified by a user input or may be obtained by mechanical position measuring means. A step S602 for receiving referential installation position information is provided following step S6, which is for making the timeout determination. The position of a device that transmitted a referential synthesized sound is received at step S602.

Whether the distance between the installation position acquired at step S601 and the referential installation position received at step S602 is shorter that a predetermined distance is determined (step S603). If it is determined that the distance is short ("YES" at step S603), processing proceeds to step S7, at which the referential feature quantity is extracted. If it is determined that the distance is not short ("NO" at step S603), on the other hand, then processing proceeds to step S5, at which the apparatus waits for receipt of the referential synthesized sound or for timeout.

Figure 11:
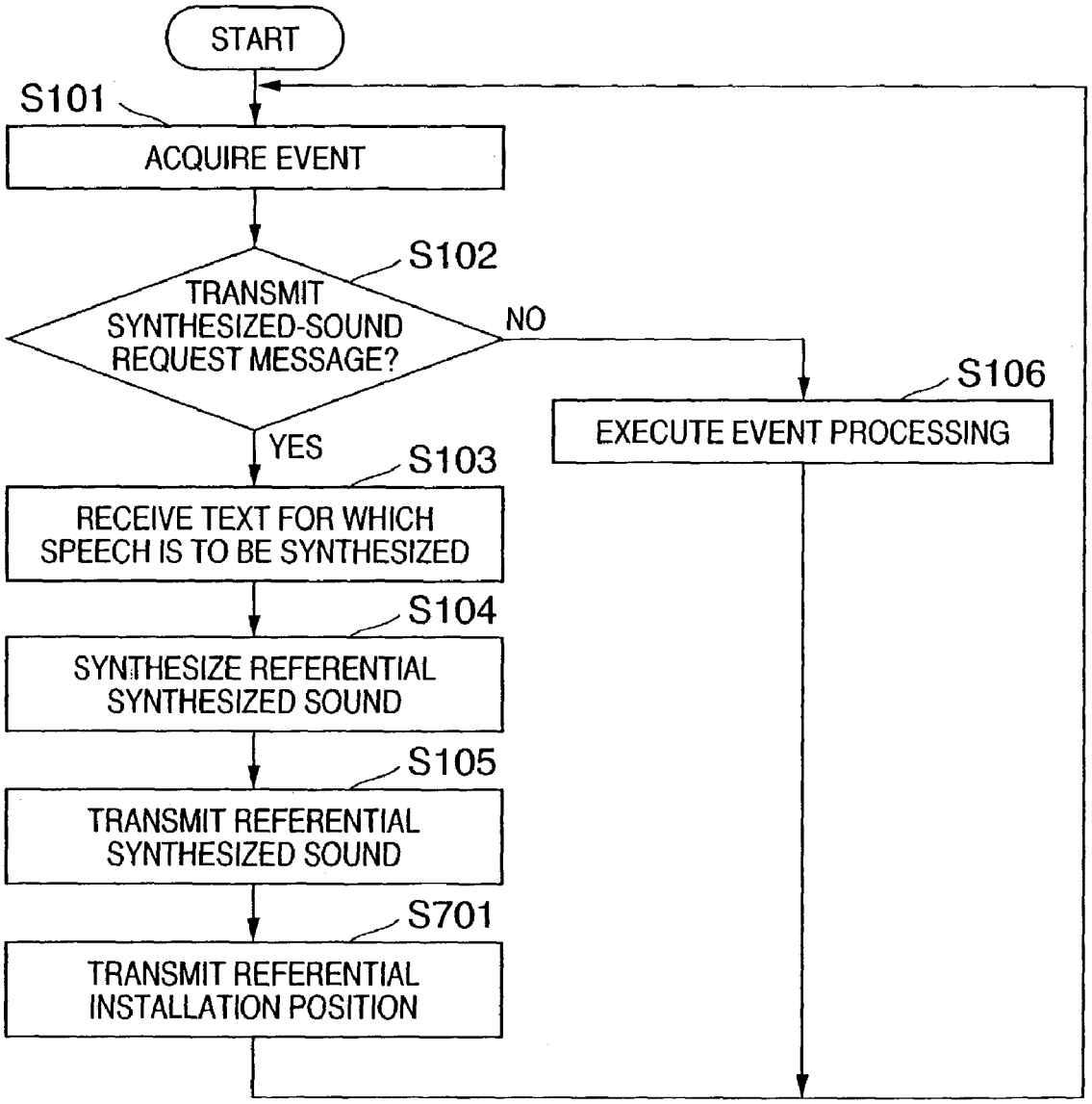
FIG. 11 is a flowchart useful in describing processing on the side of a speech output unit in a fourth embodiment of the invention.

In this embodiment, as shown in FIG. 11, a step S701 for transmitting information indicating the referential installation position is added on the side that receives the synthesized-sound request message transmitted at step S2. In other words, step S701 is added in the flow of processing of a device already installed. FIG. 11 is a flowchart useful in describing processing on the side of a speech output unit in a fourth embodiment of the invention, Though this embodiment has been described using an embodiment in which an addition is made to the first embodiment, it is similarly applicable to other embodiments.

Fifth Embodiment

The above-described embodiments are such that devices having a speech synthesizing function are on an equal footing with one another. However, an implementation in which a specific server exists also is possible.

Figure 12:
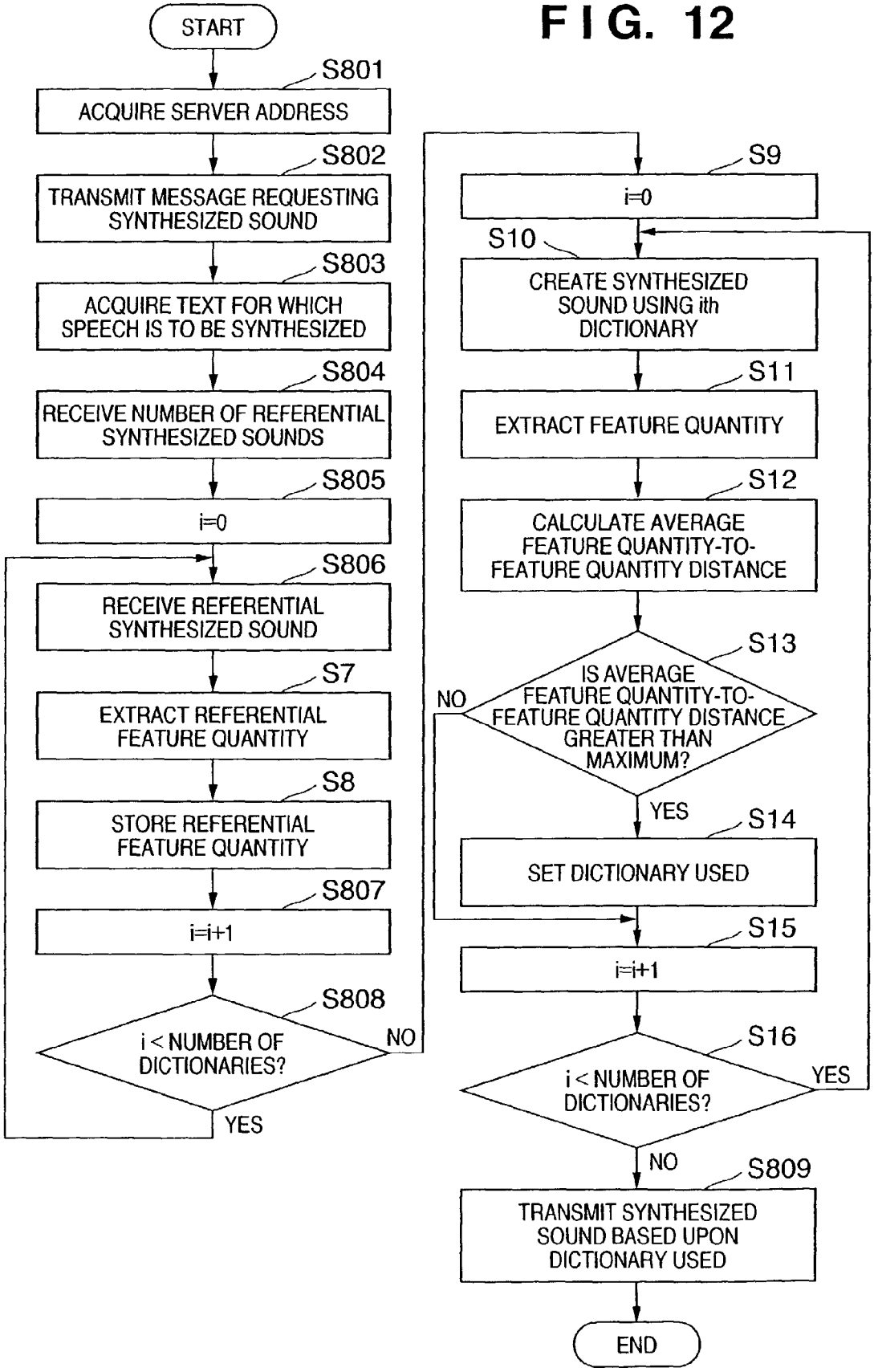
FIG. 12 is a flowchart useful in describing processing of an information processing method for controlling a speech output unit in a case where a server is present.

FIG. 12 is a flowchart useful in describing processing of an information processing method for controlling a speech output unit in a case where a server is present. This embodiment will be described as a modification of the first embodiment.

First, the address of the server is acquired (step S801). The server address may be acquired by an input from a user or by communication utilizing a broadcast to a network.

Next, a synthesized-sound request message is transmitted (step S802) to the server acquired at step S801, then text for which speech is to be synthesized is acquired (step S803). The text for which speech is to be synthesized can be acquired by being received from the server. If the text has been decided beforehand by a standard or the like, it can be read in from the ROM 6, etc.

Next, the number of referential synthesized sounds to be received from the server is received (step S804). The loop counter i is then set to 0 (step S805). Next, a referential synthesized sound is received from the server (step S806). Next, step S7, at which a referential feature quantity is extracted, and step S8, at which the referential feature quantity is stored, are executed. This is processing similar to that of the first embodiment.

More specifically, at step S7, a feature quantity speech is extracted from the referential synthesized sound received at step S806. Then, at step S8, the feature quantity extracted at step S7 is stored.

Next, the loop counter i is incremented (step S807). It is then determined (step S808) whether the value in loop counter i is less than the number of referential synthesized sounds received at step S804. If it is determined that i is less than the number ("YES" at step S808), the processing proceeds to step S806. Otherwise ("NO" at step S808), processing proceeds to step S9, at which the loop counter is set to the initial value.

It should be noted that the processing from step S9, at which the loop counter is set to the initial value, to step S16, at which it is determined whether the loop has ended, is similar to that of the first embodiment.

As shown in FIG. 12, the processing is further provided with a step 809 of transmitting the synthesized sound based upon the dictionary used. If it is found at step S16 that the loop counter value i is less than the total number of dictionaries ("NO" at step S16), the processing proceeds to step S809. At this step, the server is sent the synthesized sound synthesized at step S10 corresponding to the dictionary set at step S14.

Figure 13:
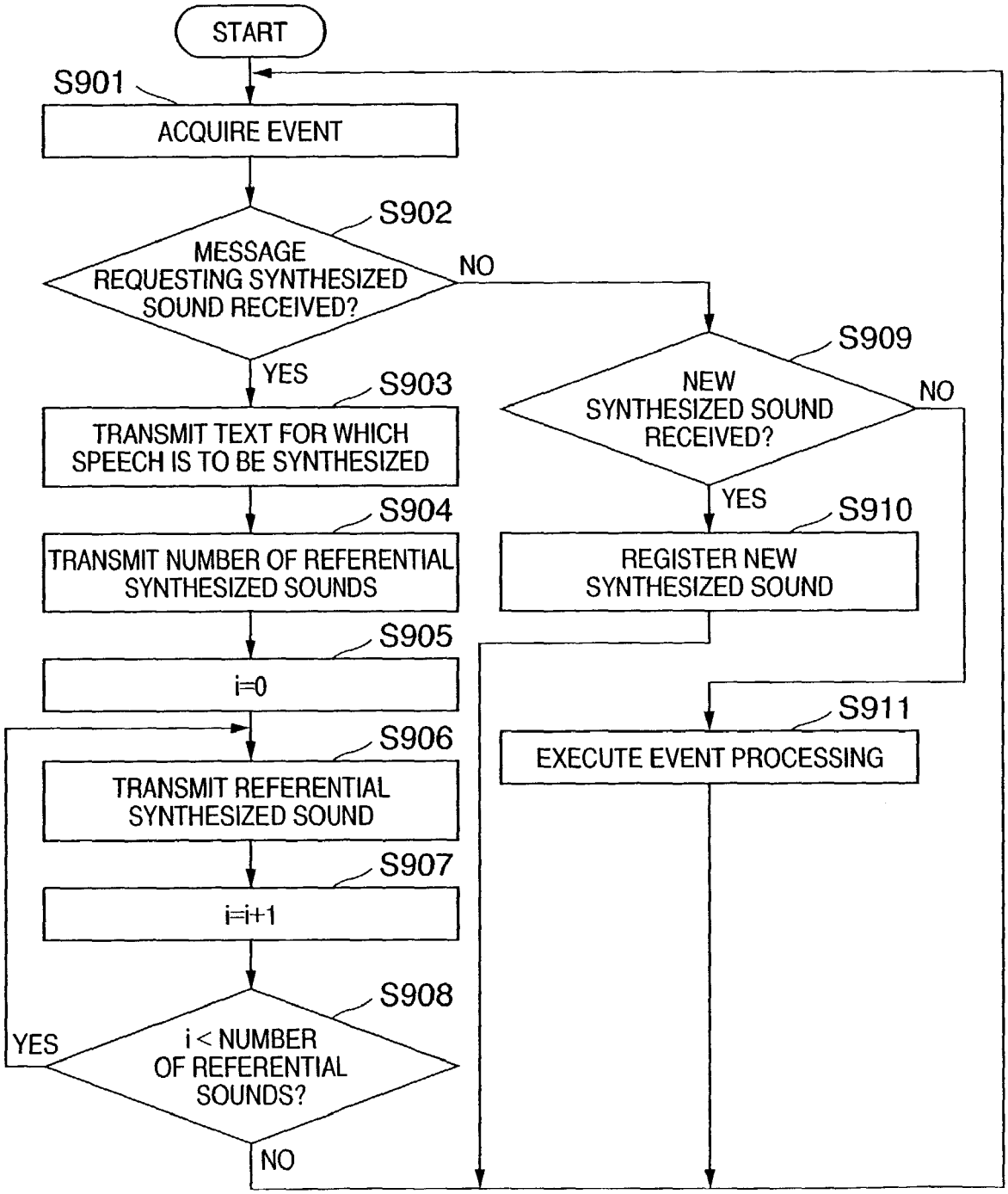
FIG. 13 is a flowchart useful in describing processing on the side of a server according to a fifth embodiment of the present invention.

FIG. 13 is a flowchart useful in describing processing on the side of a server according to a fifth embodiment of the present invention. First, the server acquires an event such as operation of a device by a user, receipt of data from a network or a change in internal status (step S901). Next, it is determined whether the event acquired at step S901 is receipt of a message requesting synthesized sound (step S902). If it is determined that such a message has been received ("YES" at step S902), then processing proceeds to step S903, at which text for which speech is to be synthesized is transmitted. Otherwise ("NO" at step S902), processing proceeds to step S909, at which a new synthesized sound is received.

Text for which speech is to be synthesized is transmitted at step S903. However, in a case where the text for which speech is to be synthesized has been defined beforehand as by a standard, this step need not be provided, as described above in connection with step S803, at which text for which speech is to be synthesized is acquired.

The number of referential synthesized sounds that have been registered in the server is transmitted (step S904), then the loop counter i is set to 0 (step S905). This is followed by transmitting the ith referential synthesized sound (step S906). The loop counter i is then incremented (step S907).

It is determined whether the loop counter i is less than the number of referential synthesized sounds (step S908). If i is found to be less than the number ("YES" at step S908), processing proceeds to step S906. Otherwise ("NO" at step S908), control proceeds to step S901.

At step S909, it is determined whether the event acquired at step S901 is receipt of a new synthesized sound. If the determination made is receipt of a new synthesized sound ("YES" at step S909), then processing proceeds to step S910, at which the new synthesized sound is registered. If a "NO" decision is rendered at step S909, processing proceeds to step S911, at which event processing is executed.

At step S910, the new synthesized sound received at step S901 is registered as a referential synthesized sound. Among events acquired at step S901, events other than receipt of the synthesized-sound request message and receipt of the new synthesized sound are processed at step S911, after which processing returns to step S901 for event acquisition.

In accordance with this embodiment, communication between devices is one-to-one communication with a server. This makes it possible to reduce the cost of communication. Further, information relating to the properties of synthesized sounds used by each of the devices can be managed upon being centralized at one location. Furthermore, in the embodiments described above, there is the danger that a problem will arise in a case where a device not operating at the time of a connection exists. By contrast, this embodiment is advantageous in that it will suffice if the server is operating.

Though the present embodiment has been described as a modification of the first embodiment, it can be applies similarly to other embodiments.

Other Embodiments

In the above-described embodiments that use text for which synthesized text is to be synthesized, it is possible to deal with erroneous reading of such text by applying speech recognition to a referential synthesized sound that has been received.

If the text has been decided beforehand by a standard or the like, it can be read in from the ROM 6, etc in the above-described embodiments. In this case, for instance, step S1 and S3 of FIGS. 1, 6, 8 and 10 become unnecessary.

The present invention can be applied to a system constituted by a plurality of devices (e.g., a host computer, interface, reader, printer, etc.) or to an apparatus comprising a single device (e.g., a copier or facsimile machine, etc.).

Further, it goes without saying that the object of the invention is attained also by supplying a recording medium (or storage medium) on which the program codes of the software for performing the functions of the foregoing embodiments to a system or an apparatus have been recorded, reading the program codes with a computer (e.g., a CPU or MPU) of the system or apparatus from the recording medium, and then executing the program codes. In this case, the program codes read from the recording medium themselves implement the functions of the embodiments, and the program codes per se and recording medium storing the program codes constitute the invention. Further, besides the case where the aforesaid functions according to the embodiments are implemented by executing the program codes read by a computer, it goes without saying that the present invention covers a case where an operating system or the like running on the computer performs a part of or the entire process based upon the designation of program codes and implements the functions according to the embodiments.

It goes without saying that the present invention further covers a case where, after the program codes read from the recording medium are written in a function expansion card inserted into the computer or in a memory provided in a function expansion unit connected to the computer, a CPU or the like contained in the function expansion card or function expansion unit performs a part of or the entire process based upon the designation of program codes and implements the function of the above embodiments.

In a case where the present invention is applied to the above-mentioned recording medium, program code corresponding to the flowcharts described earlier is stored on the recording medium.

Thus, in accordance with the present invention, as described above, even if a plurality of speech output units having a speech synthesizing function are present, a conversion is made to speech having mutually different feature quantitys so that a user can readily be informed of which unit is providing the user with information such as an alert information.

The present invention is not limited to the above embodiments and various changes and modifications can be made within the spirit and scope of the present invention. Therefore, to apprise the public of the scope of the present invention, the following claims are made.

What is claimed is:

1. A speech synthesizing apparatus for controlling a first speech synthesizing apparatus, in a case in which a second speech apparatus having a speech synthesizing function outputs a synthesized speech in concurrence with the first speech synthesizing apparatus, the speech synthesizing apparatus comprising:

a transmitting unit that transmits a message to the second speech synthesizing apparatus to request speech data;

a receiving unit that receives speech data synthesized by the second speech synthesizing apparatus;

a first extraction unit that extracts a first feature quantity relating to the received speech data;

a storage unit that stores a plurality of dictionaries for generating speech;

a second extraction unit that extracts a plurality of second feature quantities relating to speech data generated using each of the plurality of dictionaries;

a distance measuring unit that measures a distance between the first feature quantity and each of the second feature quantities;

a selection unit that selects a dictionary, which has the longest distance, from the plurality of dictionaries based on the measured distance;

a control unit that controls the first speech synthesizing apparatus to synthesize speech using the selected dictionary so that a sound-quality of the speech synthesized by the first speech apparatus is different from that of the speech synthesized by the second speech apparatus;

a first location information acquisition unit that acquires location information of the first speech synthesizing apparatus; and a second location information acquisition unit that acquires location information of the second speech synthesizing apparatus;

wherein said control unit controls the first speech synthesizing apparatus to synthesize speech using the selected dictionary in a case where distance to the second speech synthesizing apparatus falls within a predetermined range.

2. A speech synthesizing method for controlling a first speech synthesizing apparatus, in a case in which a second speech synthesizing apparatus having a speech synthesizing function outputs a synthesized speech in concurrence with the first speech synthesizing apparatus, the method comprising:

a transmission step of transmitting a message to the second speech synthesizing apparatus to request speech data;

a reception step of receiving speech data synthesized by the second speech synthesizing apparatus;

a first extraction step of extracting a first feature quantity relating to the received speech data;

a second extraction step of extracting a plurality of second feature quantities relating to speech data generated using each of a plurality of dictionaries stored in a storage;

a distance measuring step of measuring a distance between the first feature quantity and each of the second feature quantities;

a selection step of selecting a dictionary, which has the longest distance, from the plurality of dictionaries based on the measured distance;

a control step of controlling the first speech synthesizing apparatus to synthesize speech using the selected dictionary so that a sound-quality of the speech synthesized by the first speech apparatus is different from that of the speech synthesized by the second speech apparatus;

a first location information acquisition step of acquiring location information of the first speech synthesizing apparatus; and a second location information acquisition step of acquiring location information of the second speech synthesizing apparatus;

wherein the first speech synthesizing apparatus is controlled to synthesize speech using the selected dictionary in a case where distance to the second speech synthesizing apparatus falls within a predetermined range.

3. A computer program stored on a computer-readable non-transitory storage medium for controlling a first speech synthesizing apparatus, in a case in which a second speech synthesizing apparatus having a speech synthesizing function outputs a synthesized speech in concurrence with the first speech synthesizing apparatus, the program causing the computer to functioning as:

a transmitting unit that transmits a message to a second speech synthesizing apparatus for requesting speech data;

a receiving unit that receives speech data synthesized by the second speech synthesizing apparatus;

a first extraction unit that extracts a first feature quantity relating to the received speech data;

a storage unit that stores a plurality of dictionaries for generating speech;

a second extraction unit that extracts a plurality of second feature quantities relating to speech data generated using each of the plurality of dictionaries;

a distance measuring unit that measures a distance between the first feature quantity and each of the second feature quantities;

a selection unit that selects a dictionary, which has the longest distance, from the plurality of dictionaries based on the measured distance;

a control unit that controls the first speech synthesizing apparatus to synthesize speech using the selected dictionary so that a sound-quality of the speech synthesized by the first speech apparatus is different from that of the speech synthesized by the second speech apparatus;

a first location information acquisition unit that acquires location information of the first speech synthesizing apparatus; and a second location information acquisition unit that acquires location information of the second speech synthesizing apparatus;

wherein said control unit controls the first speech synthesizing apparatus to synthesize speech using the selected dictionary in a case where distance to the second speech synthesizing apparatus falls within a predetermined range.

* * * * *